US007798486B2

(12) United States Patent
Hasegawa et al.

(10) Patent No.: US 7,798,486 B2
(45) Date of Patent: Sep. 21, 2010

(54) IMAGE FORMING APPARATUS INCLUDING SHEET CONTAINER WITH HANDLE

(75) Inventors: Koichi Hasegawa, Tokyo (JP); Shinichi Kato, Tokyo (JP); Shigeru Horiguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 800 days.

(21) Appl. No.: 11/646,508

(22) Filed: Dec. 28, 2006

(65) Prior Publication Data

US 2007/0172277 A1 Jul. 26, 2007

(30) Foreign Application Priority Data

Dec. 28, 2005 (JP) ..... 2005-376824
Dec. 11, 2006 (JP) ..... 2006-333343

(51) Int. Cl.
*B65H 1/00* (2006.01)

(52) U.S. Cl. ..... 271/145; 271/162; 16/406; 16/411; 16/415; 16/416; 16/419; 16/420; 16/413; 16/422; 16/425; 16/426; 16/427

(58) Field of Classification Search ..... 271/145, 271/162; 16/415, 416, 419, 420, 413, 422, 16/425, 426, 427, 406, 411, DIG. 24, 28, 16/5

See application file for complete search history.

(56) References Cited

U.S. PATENT DOCUMENTS 1,402,385 A * 1/1922 Terrell ..... 220/646
2,407,763 A * 9/1946 North et al. ..... 16/419
2,498,139 A * 2/1950 Simjian ..... 248/467
3,311,943 A * 4/1967 Budai ..... 16/419
3,621,510 A * 11/1971 Rollins, Jr. ..... 16/422
5,715,500 A 2/1998 Nakazato et al.
5,974,627 A * 11/1999 Huang ..... 16/422
6,075,958 A 6/2000 Gotoh et al.
6,113,094 A 9/2000 Horiguchi et al.

(Continued)

FOREIGN PATENT DOCUMENTS

JP 05-142872 6/1993

(Continued)

OTHER PUBLICATIONS

Search Report dated Apr. 12, 2007 for corresponding European Application No. 06126905.6.

*Primary Examiner*—Patrick Mackey
*Assistant Examiner*—Prasad V Gokhale
(74) *Attorney, Agent, or Firm*—Harness, Dickey & Pierce, P.L.C.

(57) ABSTRACT

An image forming apparatus may include an image forming mechanism to form an image and to transfer the image onto a recording sheet and a container configured to contain the recording sheet. The container may include a container part, a handle attachment part, and/or a handle. The handle may be attached to the handle attachment part. The handle may be attachable to and detachable from the container and to pull out the container from the image forming apparatus. The handle may include an insertion part, a handle part, and/or a grip. The insertion part is configured to attach the handle to the container. The handle part may be configured to protrude from a front surface of the container and to include a through-hole and a grip to be held through the through-hole.

18 Claims, 8 Drawing Sheets

U.S. PATENT DOCUMENTS

| | | | | |
|---|---|---|---|---|
| 6,128,455 | A | 10/2000 | Horiguchi et al. | |
| 6,260,843 | B1 | 7/2001 | Hoshimura et al. | |
| 6,328,298 | B1 | 12/2001 | Suzuki et al. | |
| 6,486,419 | B2 | 11/2002 | Horiguchi et al. | |
| 6,591,069 | B2 | 7/2003 | Horiguchi | |
| 6,736,392 | B1 | 5/2004 | Horiguchi et al. | |
| 6,755,733 | B2 | 6/2004 | Horiguchi et al. | |
| 6,978,107 | B2 * | 12/2005 | Nagashima et al. | 399/262 |
| 6,980,735 | B2 | 12/2005 | Horiguchi | |
| 6,993,809 | B2 * | 2/2006 | Chin-Kang | 16/425 |
| 7,198,266 | B2 * | 4/2007 | Takahashi et al. | 271/171 |
| 2004/0041334 | A1 * | 3/2004 | Yoshihara | 271/145 |
| 2004/0131384 | A1 * | 7/2004 | Miyaji et al. | 399/124 |
| 2004/0173499 | A1 * | 9/2004 | Chin-Kang | 206/710 |
| 2006/0013580 | A1 | 1/2006 | Horiguchi | |
| 2006/0103858 | A1 | 5/2006 | Yamada et al. | |
| 2006/0210336 | A1 | 9/2006 | Horiguchi et al. | |
| 2007/0220797 | A1 * | 9/2007 | Antal et al. | 40/658 |

FOREIGN PATENT DOCUMENTS

| | | |
|---|---|---|
| JP | 10-101237 | 4/1998 |
| JP | 11-198483 | 7/1999 |
| JP | 2001-117470 | 4/2001 |
| JP | 2004-091126 | 3/2004 |
| JP | 2001-219934 | 8/2004 |
| JP | 2004-215745 | 8/2004 |

* cited by examiner

IMAGE FORMING APPARATUS INCLUDING SHEET CONTAINER WITH HANDLE

BACKGROUND

1. Field

Example embodiments generally relate to an image forming apparatus including a container with a handle, for example, to an image forming apparatus including a container with an attachable/detachable handle.

2. Discussion of the Background

In general, a background image forming apparatus, for example, a copying machine, a printer, a facsimile machine, etc., may include an image forming mechanism for forming an image, e.g., a toner image, and a sheet container for storing a recording sheet, e.g., a paper sheet, and/or a sheet conveyance unit for conveying the recording sheet to the image forming mechanism.

These image forming apparatuses may include a sheet container stowed in a main body of the image forming apparatus. Such a sheet container may include a case part to contain the recording sheets and a handle for an operator to pull out the sheet container from the main body of the image forming apparatus, for example, to replenish recording sheets in the sheet container.

However, the handle for the sheet container may be designed for people having no disabilities or designed with emphasis on appearance and the shape of the handle is not selectable. Such a handle may not be easy-to-use for everyone. For example, the handle designed for people having no disabilities may be inconvenient for people having hand disabilities and a handle designed for domestic users may be inconvenient for use in foreign countries because of physical differences.

SUMMARY

In example embodiments, an image forming apparatus may be provided with a sheet container whose handle is separately formed from its case part to enhance flexibility in designing the handle of the sheet container. In example embodiments, the handle part may be screwed to the case part.

In example embodiments, an image forming apparatus may include an image forming mechanism to form an image and to transfer the image onto a recording sheet and a container configured to contain the recording sheet. The container may include a container part, a handle attachment part, and/or a handle. The handle may be attached to the handle attachment part. The handle may be attachable to and detachable from the container and to pull out the container from the image forming apparatus. The handle may include an insertion part and a handle part. The insertion part may be configured to attach the handle to the container. The handle part may be configured to protrude from a front surface of the container and to include a through-hole and a grip to be held through the through-hole.

In example embodiments, a container may include a container part, a handle attachment part, and/or a handle. The handle may be attached to the handle attachment part. The handle may be attachable to and detachable from the container and to pull out the container from a structure in which the container is included. The handle may include an insertion part and a handle part. The insertion part may be configured to attach the handle to the container. The handle part may be configured to protrude from a front surface of the container and to include a through-hole and a grip to be held through the through-hole.

In example embodiments, a handle may be attachable to and detachable from a part to pull out the part from a structure in which the part is included. The handle may include an insertion part and a handle part. The insertion part may be configured to attach the handle to the part. The handle part may be configured to protrude from a front surface of the part and to include a through-hole and a grip to be held through the through-hole.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
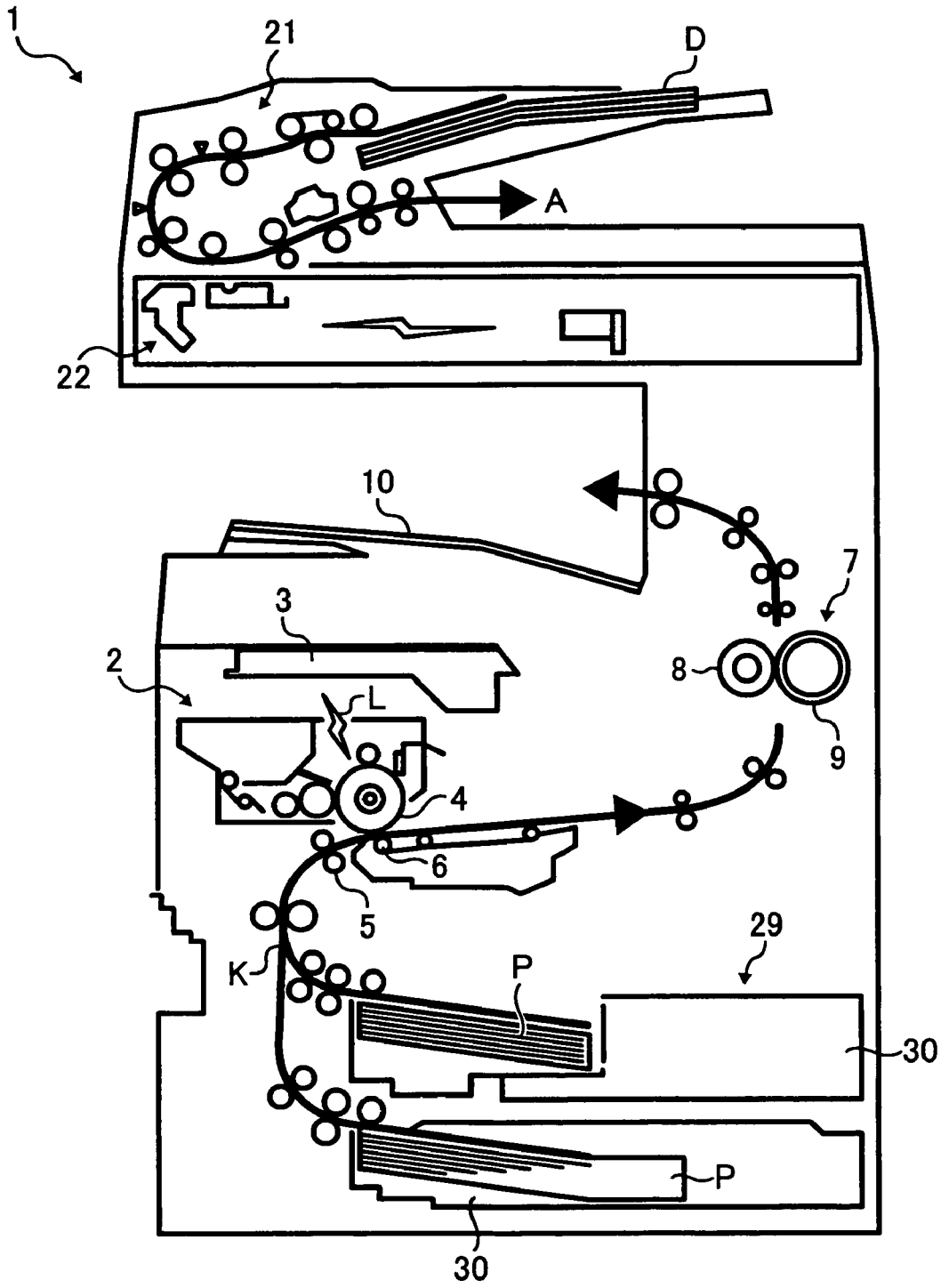
FIG. 1 is an illustration of an image forming apparatus according to an example embodiment.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1 according to example embodiments is described.

As illustrated in FIG. 1, the image forming apparatus 1 may be a digital copier and may include a process cartridge 2, a pair of registration rollers 5, a transfer device 6, a fixing unit 7, and/or a discharge tray 10. The image forming apparatus 1 may further include a document feeder 21 and a reading part 22 in its upper part and/or a sheet feeder 29 in its lower part.

The document feeder 21 may forward an original document D to the reading part 22 that may read image information on the original document D.

The process cartridge 2 may integrally include an exposure device 3, a photoconductor drum 4, a charger (not shown), a developing unit (not shown), and/or a cleaning device (not shown) as an image forming mechanism. The process cartridge 2 may be attachable to and detachable from the image forming apparatus 1.

The exposure device 3 may emit light L on a surface of the photoconductor drum 4 that may be charged by the charger. Thus, the photoconductor drum 4 may form an electrostatic latent image. The developing unit may include a toner (developer) and develop the electrostatic latent image into a toner image. The cleaning device may remove the toner remaining on the photoconductor drum 4 that is not used in the developing process.

In the image forming apparatus 1, a sheet conveyance passage K may extend from the sheet feeder 29 to the discharge tray 10. The sheet feeder 29 may include a plurality of sheet cassettes 30 that are containers to store a plurality of sheets P. The pair of registration rollers 5 provided upstream of the transfer device 6 in the sheet conveyance passage K may send a sheet P as a recording sheet to the transfer device 6. The transfer device 6 may transfer the toner image formed on the photoconductor drum 4 onto the sheet P. The fixing unit 7 may include a fixing roller 8 and a pressing roller 9 and may fix the image on the sheet P.

Referring to FIG. 1, typical image forming processes employing an electronographic method are described.

The original document D may be sent by a plurality pairs of transport rollers (not shown) in a direction shown by arrow A. When the original document D passes above the reading part 22, the reading part 22 may optically read the image information on the original document and convert the image information into an electric signal. The electric signal may be sent to the exposure device 3 that may act as a writing part. The exposure device 3 may emit an exposure light L based on the electric signal to the photoconductor drum 4.

The photoconductor drum 4 may rotate counterclockwise in FIG. 1. The photoconductor drum 4 may form an electrostatic latent image corresponding the image information thereon through a charging process and the exposure process and may develop the electrostatic latent image into a toner image in a developing process. The transfer device 6 may transfer the toner image onto the sheet P sent by the pair of registration rollers 5.

In the sheet feeder 29, one of the plurality of sheet cassettes 30 may be automatically or manually selected. In example embodiments, a top sheet cassette 30 may be selected. A top sheet P on the sheet cassette 30 may be sent out and conveyed through the sheet conveyance passage K to the pair of registration rollers 5. The pair of registration rollers 5 may timely forward the sheet P to the transfer device 6 so that the toner image formed on the photoconductor drum 4 may be transferred at a desired position on the sheet P.

The sheet P may be conveyed to the fixing unit 7 after passing through the transfer device 6. The fixing unit 7 may sandwich the sheet P between the fixing roller 8 and the pressing roller 9. After the toner image on the sheet P is fixed with heat from the fixing roller 8 and pressure from the pressing roller 9, the sheet P may be discharged from the image forming apparatus 1 onto the discharge tray 10 as an output image. Thus, image forming processes are completed.

Figure 2:
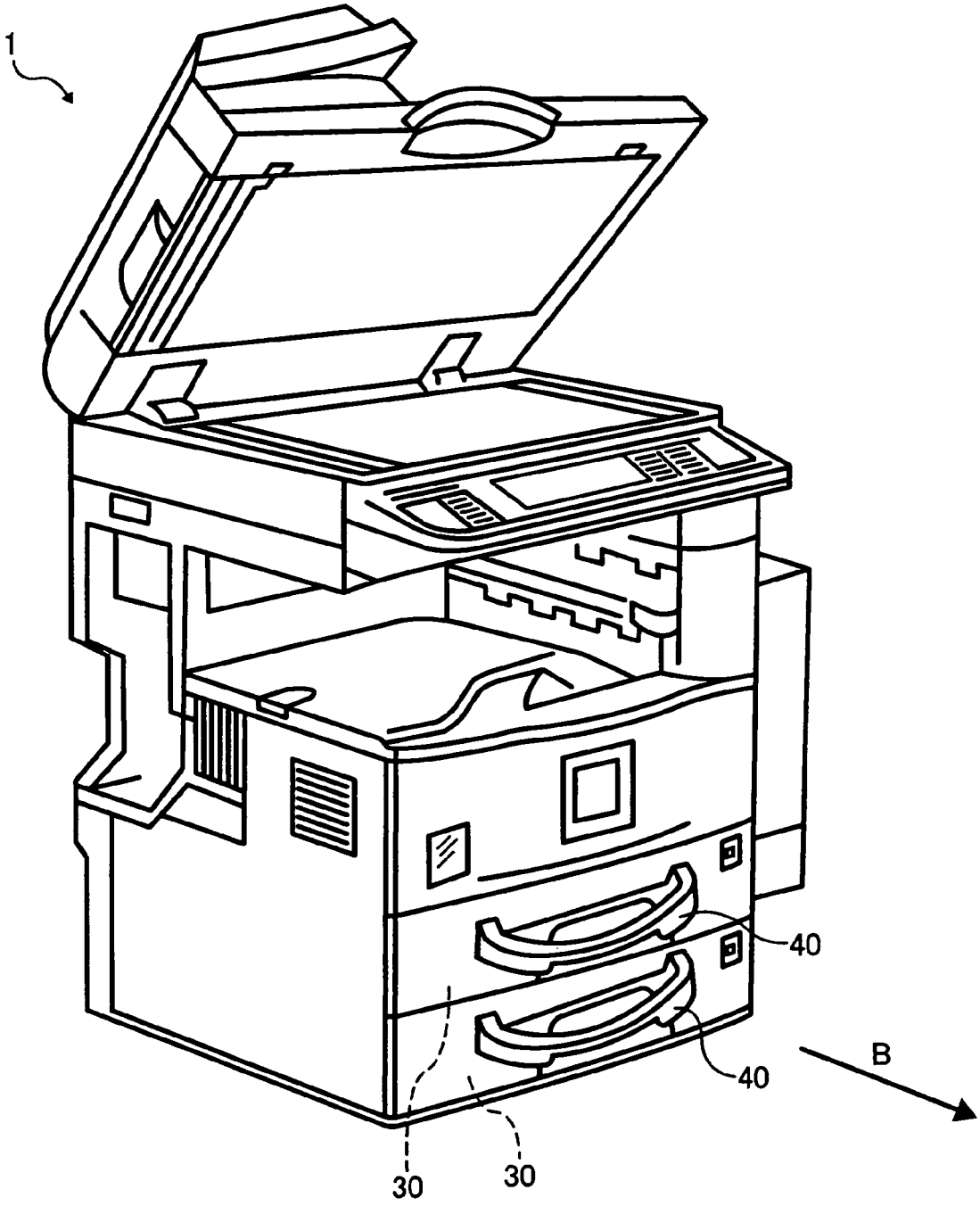
FIG. 2 is an example illustration of the image forming apparatus 1 of FIG. 1.

The sheet cassettes 30 are described with reference to FIG. 2. As illustrated in FIG. 2, a handle 40 may be attached to each of the sheet cassettes 30. An operator may grasp the handle 40 to pull out the sheet cassette 30 (in a direction shown by arrow B) or to push the sheet cassette 30 into the image forming apparatus 1 (in a direction opposite to arrow B), for example, to replenish the sheet cassette 30 with sheets P. The handle 40 may contain, for example, PC-ABS (polycarbonate acrylonitrile-butadiene-styrene), to reduce const and environmental effects.

Figure 3:
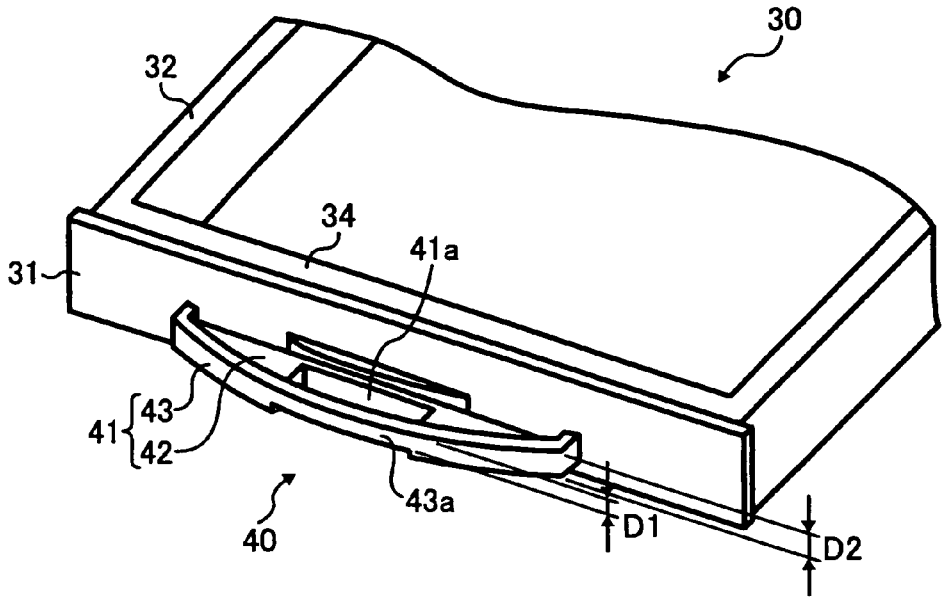
FIG. 3 is an example illustration of a sheet cassette and its handle included in the image forming apparatus of FIG. 2.
Figure 4:
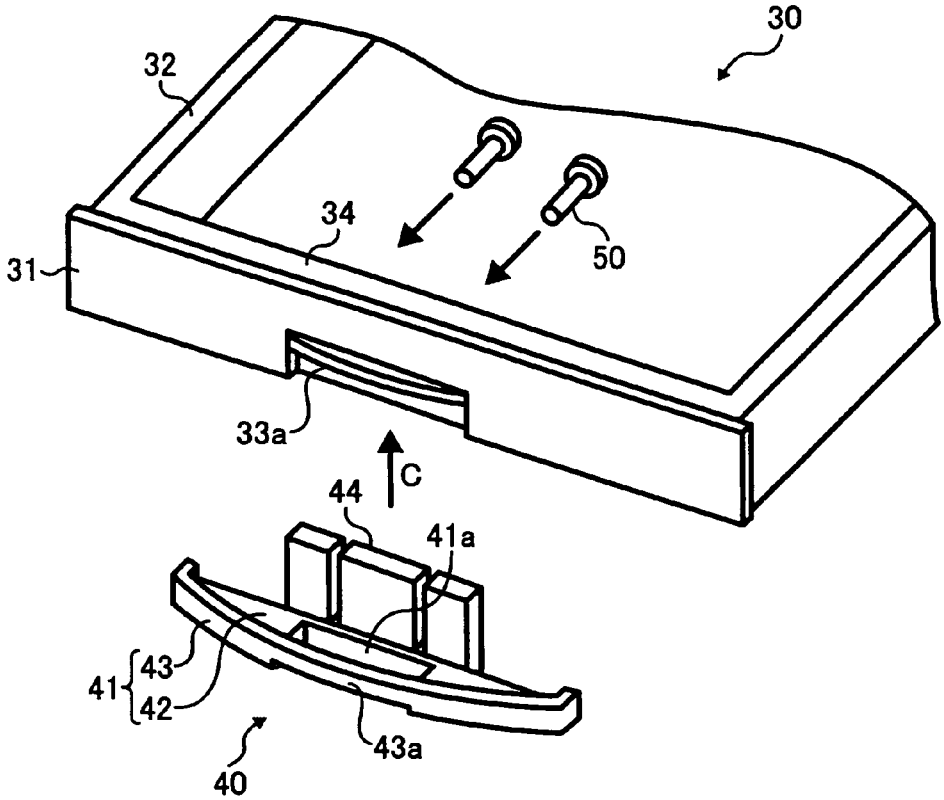
FIG. 4 is an example illustration to explain installation of the handle to the sheet cassette of FIG. 3.

Example embodiments of the sheet cassette 30 and the handle 40 are described with reference to FIGS. 3 and 4. The sheet cassette 30 may include a cover 31 and a container part 32. The cover 31 is an outer cover to cover a front side of the container part 32 in which the sheets P are contained. The container part 32 may include a front wall 34. The cover 31 may include a pull part 33*a*.

The front wall 34 may be configured to have a height lower than a height of the cover 31 and to form steps with the cover 31.

The pull part 33*a* may include an upward concavity to which an operator may insert a hand and grasp the pull part 33*a*. The pull part 33*a* may be provided on the cover 31 of the sheet cassette 30 as a standard handle. The pull part 33*a* may be designed for an operator having no disabilities, with emphasis on appearance. The operator having no disabilities may grasp the pull part 33*a* to pull out the sheet cassette 30. The pull part 33*a* may have an attractive appearance and a small footprint because the pull part 33*a* does not protrude from a front surface of the cover 31.

The handle 40 may be optionally attached to the sheet cassette 30. The handle 40 may be offered to an operator, for example, an operator having hand disabilities, who thinks the standard pull part 33*a* is not convenient. In FIG. 3, the handle 40 may include a handle part 41 protruding from the front surface of the cover 31 when the handle 40 is attached to the sheet cassette 30.

The handle part 41 may include a through-hole 41*a*, a plate 42, a front plate 43, and/or a grip 43*a*. The through-hole 41*a* may be provided on the plate 42. The front plate 43 may cover a front edge of the plate 42 and include a center part and a first end and a second end. The grip 43*a* may be provided at the center part of the front plate 43. The first and second ends may be in contact with the front surface of the sheet cassette 30 (cover 31). The front plate 43 may have a vertical thickness D2 and the grip 43*a* may have a vertical thickness D1. The vertical thickness D1 of grip 43*a* may be smaller than the vertical thickness D2 of front plate 43 (D1<D2).

Figure 5:
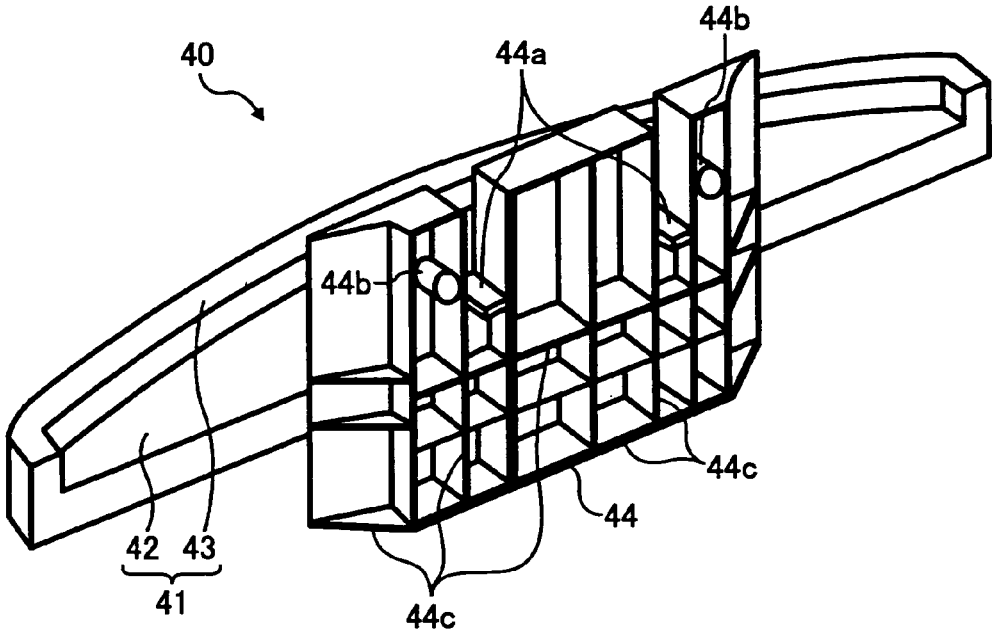
FIG. 5 is an example illustration of the handle of FIG. 3.

The attachment of the handle 40 to the cassette 30 is described with reference to FIGS. 4 to 6. As illustrated in FIG. 4, the handle 40 may further include an insertion part 44 and a pair of screws 50. The insertion part 44 may be connected to a back edge of the plate 42. The insertion part 44 may be inserted from beneath into the pull part 33*a* that serves as a handle attachment part. The pair of screws 50 may be inserted from an inner surface of the sheet cassette 30 to fasten the insertion part 44 to the sheet cassette 30.

The insertion part 44 may be engaged with the pull part 33*a*, which is to be described in detail with reference to FIGS. 5 and 6. As illustrated in FIG. 5, the insertion part 44 may include a pair of pawls 44*a*, a pair of bosses 44*b*, and/or a rib 44*c*. The pair of pawls 44*a* may be configured to serve as a positioning part and to be rested on an upper surface of the front wall 34 when the insertion part 44 is engaged with the pull part 33*a*. Because the front wall 34 and the cover 31 forms steps, the pawls 44*a* may be temporarily locked and a position of the handle 40 relative to the sheet cassette 30 may be determined. Alternatively, the pawls 44*a* may be permanently locked to the sheet cassette 30.

The pair of bosses 44*b* may protrude from the back of the insertion part 44 toward the cover 31 when the handle 40 is attached to the sheet cassette 30. The pair of bosses 44*b* may be used to fasten the handle 40. The screws 50 may be inserted into the bosses 44*b*, respectively.

The rib 44*c* may be a lattice-shaped part and may be provided on the back side of the insertion part 44 that may be a sheet cassette side for additional strength. In addition to or instead of the rib 44*c*, a lattice-shaped rib (not shown) may be provided on a back surface of the handle part 41 to enhance mechanical strength of the handle 40. Proving such lattice-shaped ribs may reduce material cost.

As the insertion part 44 may be provided separately from the handle part 41 as described above, a shape of the handle part 41 may be more freely designed. Therefore, the handle part 41 may be designed more specifically to the needs of customers. For example, a handle 40 including a larger handle part 41 may be attached to the sheet cassette 30. Therefore, it may be desirable to configure the handle 40 to be attachable to and detachable from the sheet cassette 30 (replaceable).

Figure 6:
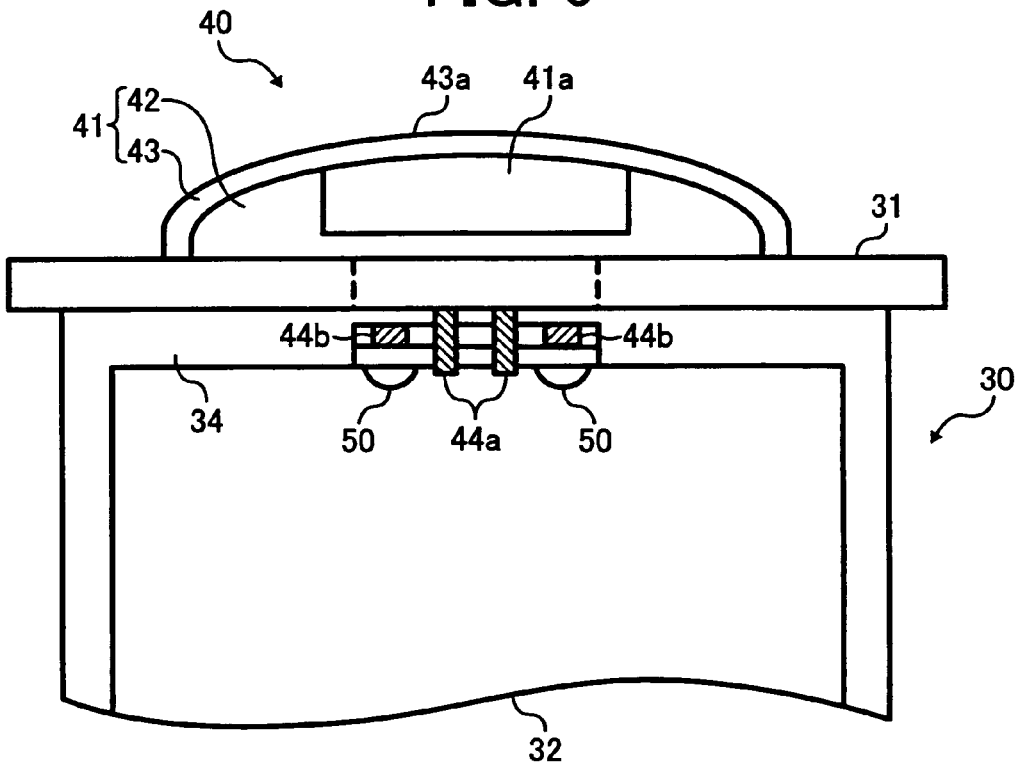
FIG. 6 is a top view of the sheet cassette and the handle of FIG. 3.

Operability of the handle part 41 is described, referring to FIG. 6. The vertical thickness D1 of grip 43*a* may be smaller than the vertical thickness D2 of front plate 43 as described above (FIG. 3). Further, the through-hole 41*a* may be large enough for an operator to insert fingers therein to hold the grip 43*a* and a width of the through-hole 41*a* may be substantially same as a width of the insertion part 44.

Accordingly, even an operator having hand disabilities may easily hold the grip 43*a*. The grip 43*a* may be easily held by an artificial hand and/or a tool because the through-hole 41*a* is provided. Because force acting to the insertion part 44 when an operator holds the grip 43*a* may be equalized, the handle 40 may maintain its strength and the operator may easily pull the cassette 30. Even if the operator fails to catch the grip 43*a* with an artificial hand and/or a tool, the artificial hand and/or the tool is more likely to hold on somewhere on the front plate 43 because an upper surface of the front plate 43 and an upper surface of the plate 42 form steps.

The grip 43*a* may be held from above and from beneath because of the through-hole 41*a*. For example, a height within reach for an operator in a wheelchair may be limited and the operator may have difficulty holding the grip 43*a* from above. In such a case, the operator may hold the grip 43*a* from beneath. The operability of the handle 40 may be enhanced as described above.

Further, the front plate 43 of the handle part 41 may be curved from its first and second ends connected to the front surface of the cover 31 of the sheet cassette 30 toward its center part in which the through-hole 41*a* is formed. In other words, the handle part 41 may be configured to protrude from the surface of the cover 31 gently from the both ends toward the center part. Therefore, injuries that may occur when an operator collides with the handle 40 may be decreased or prevented, even if a larger handle 40 is adopted.

As illustrated in FIG. 6, the pawls 44*a* may be caught on the upper surface of the front wall 34 and the handle 40 may be integrated to the sheet cassette 30 by the screws 50 fastened into the bosses 44*b*. The front wall 34 may be configured so that the bosses 44*b* are visible from above. Therefore, the screws 50 may be easily fastened into the bosses 44*b*. The screws 50 do not appear outside of the sheet cassette 30 and/or the handle 40, which may prevent the operator from being hooked by the screws 50 and enhance the appearance of the handle 40. The handle 40 may be securely attached to the sheet cassette 30 because of the screws 50 and the bosses 44*b*.

As described above, a handle 40 may be specifically designed for the needs of an operator and may be selectably installed on the sheet cassette 30.

The insertion part 44 may be inserted into the pull part 33*a* from above, although the insertion part 44 may be inserted from beneath in example embodiments.

Figure 7:
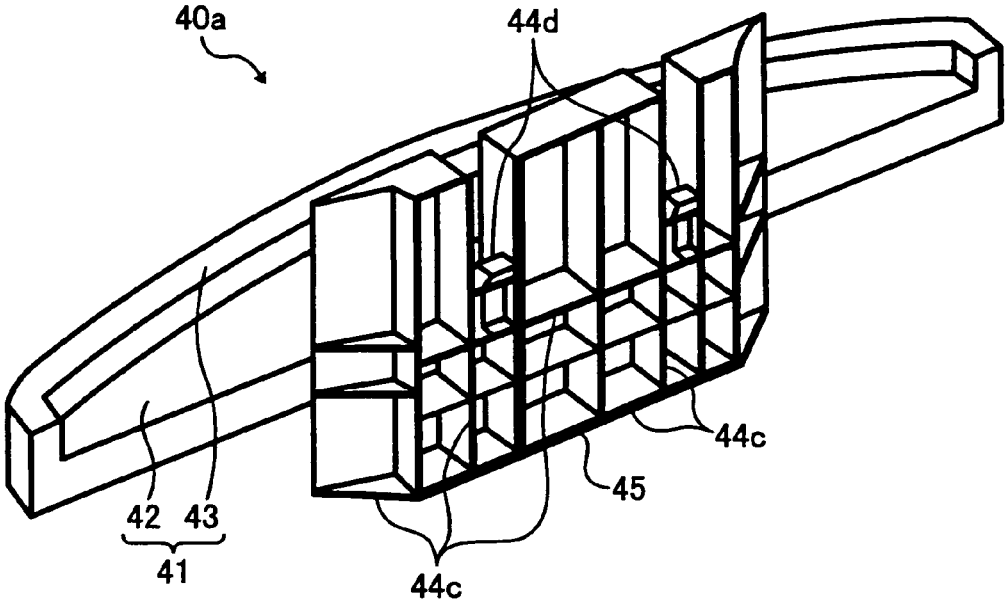
FIG. 7 is an illustration of a handle according to an example embodiment.

Another example embodiment is described with reference to FIGS. 7 to 9. As illustrated in FIG. 7, a handle 40*a* may include a handle part 41, a plate 42, a front plate 43, an insertion part 45, and/or a rib 44*c*. The handle 40*a* may further include a pair of snap-fit parts 44*d* on a back side of the insertion part 45, instead of the pawls 44*a* and the bosses 44*b* included in the handle 40 illustrated in FIGS. 3 to 6.

Figure 8:
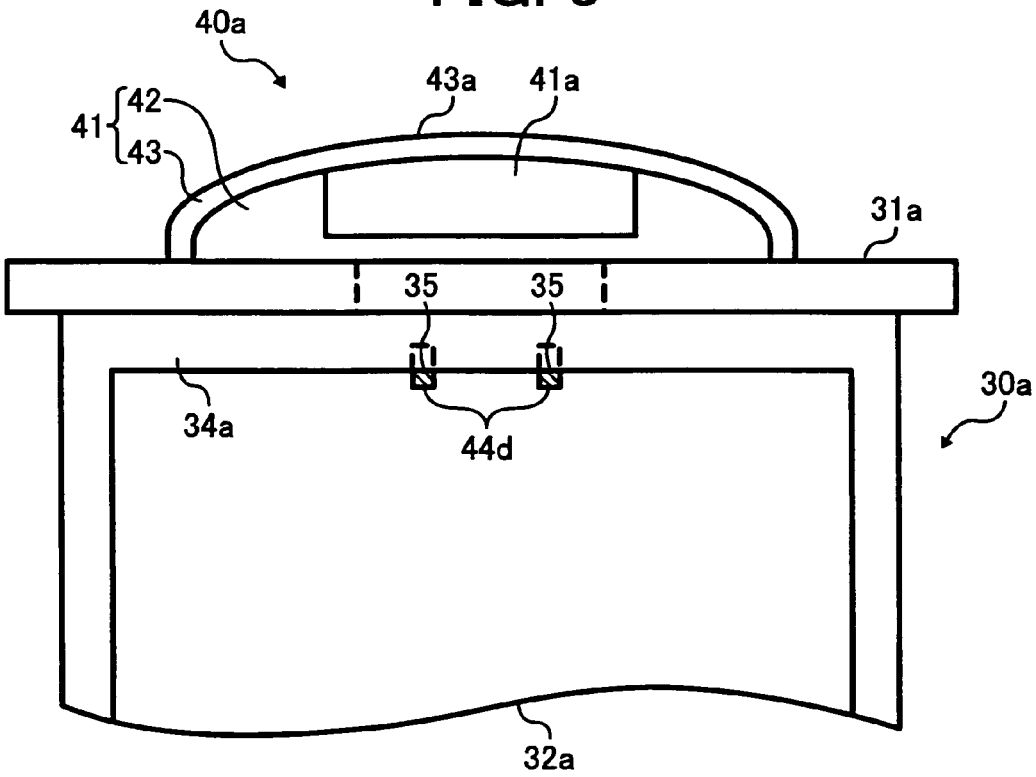
FIG. 8 is a top view of an example sheet cassette to which the handle of FIG. 7 is attached.

As illustrated in FIG. 8, a sheet cassette 30*a* may include a cover 31*a*, a container part 32*a*, a front wall 34*a*, and/or a pull part 33*a* (not shown). The sheet cassette 30*a* may further include a pair of holes 35 provided on the front wall 34. The handle 40*a* may be inserted to the pull part 33*a* of the sheet cassette 30 from beneath. The handle 40*a* may further include a grip 43*a*. The insertion part 45 may be engaged with the pull part 33*a* similarly to the handle 40.

Figure 9:
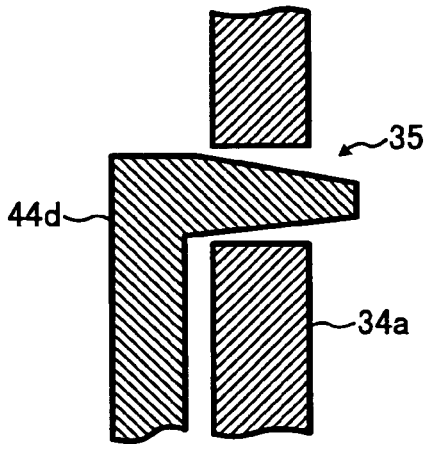
FIG. 9 is an example illustration to explain engagement of a snap-fit part with the sheet cassette of FIG. 8.

As illustrated in FIG. 9, when the handle 40*a* is inserted into the pull part 33*a*, the pair of snap-fit parts 44*d* may be engaged into the holes 35 on the front wall 34 of the sheet cassette 30*a* as a positioning part. Thus, the position of the handle 40*a* relative to the sheet cassette 30*a* may be determined and the handle 40*a* may be fastened to the sheet cassette 30*a*. Because of the snap-fit parts 44*d*, the handle 40*a* may be quickly attached to and detached from the sheet cassette 30*a*. The pair of snap-fit parts 44*d* may be provided far enough from the grip 43*a* so that the handle 40*a* is not accidentally disengaged from the sheet cassette 30*a* when an operator touches the handle 40*a*. In other respects, each part of the sheet cassette 30*a* and the handle 40*a* may have a similar configuration to the corresponding part of the sheet cassette 30 and the handle 40 illustrated in FIGS. 5 to 6.

A handle 40*b* according to another example embodiment is described with reference to FIGS. 10A and 10B. The handle 40*b* may be attached to a sheet cassette 30*b* in a different method from the attachment method of the handle 40 illustrated in FIGS. 4 to 6.

Figure 10A:
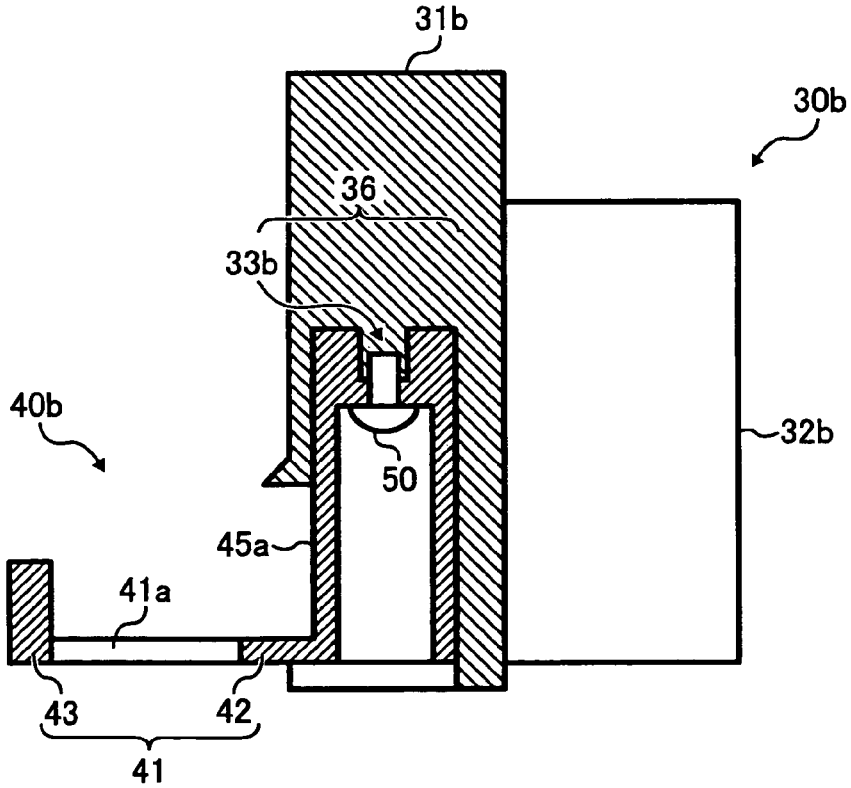
FIG. 10A is a cross section diagram of a handle attached to a sheet cassette.

Referring to FIG. 10A, the sheet cassette 30*b* may include a cover 31*b*, a container part 32*b*, and a pull part 36. The pull part 36 may include an upward concavity to which an operator may insert a hand to grasp the pull part 36. The pull part 36 may further include a boss 33*b* as a handle attachment part that may be provided on a ceiling of the upward concavity. The handle 40*b* may include a handle part 41, an insertion part 45*a*, and a screw 50. The handle part 41 may include a plate 42 and a front plate 43. Although not shown in FIG. 10, the handle 40*b* may include a grip 43 similar to the handle 40 illustrated in FIG. 3. The insertion part 45*a* may include a downward concavity on its top surface.

Figure 10B:
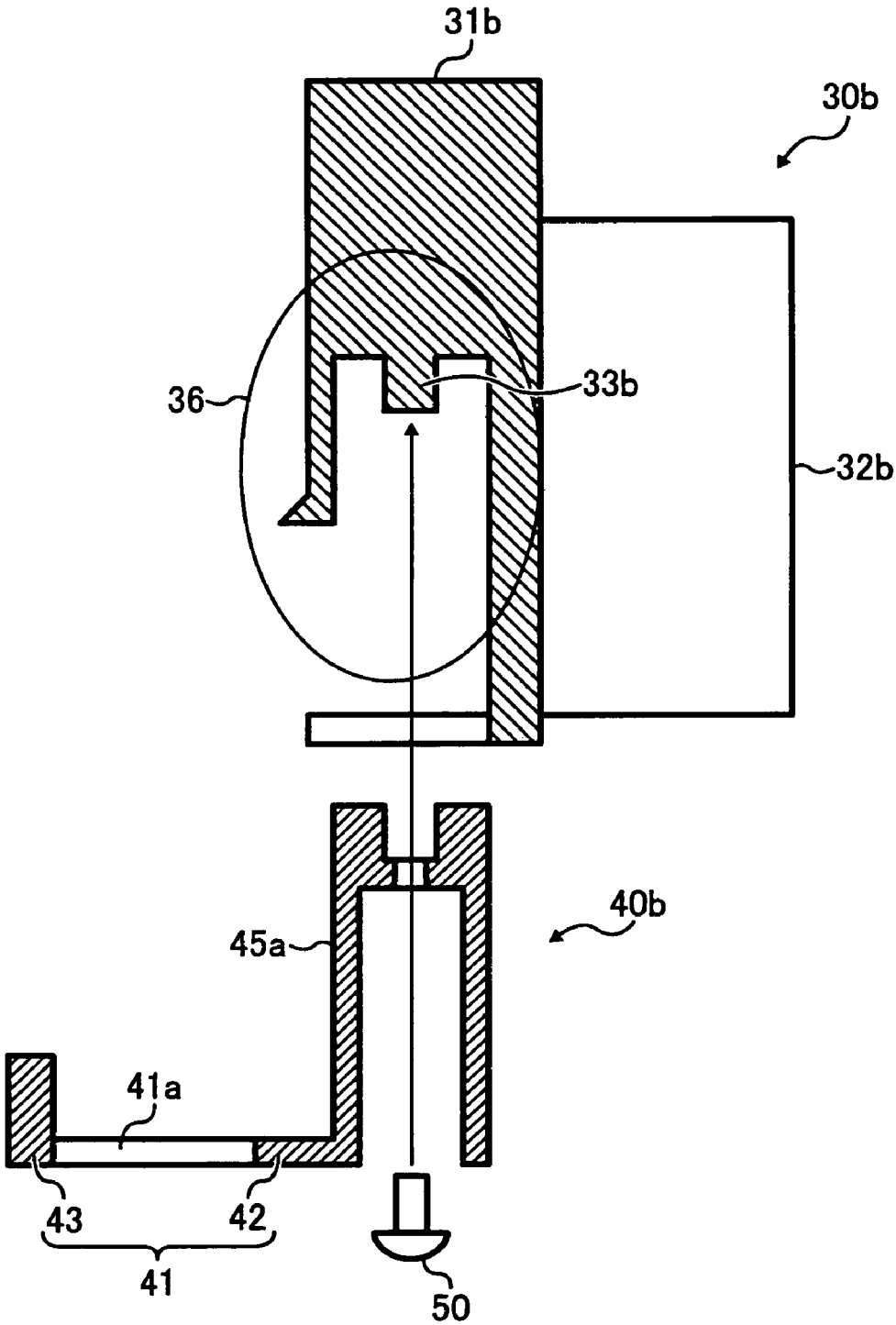
FIG. 10B is an example illustration to explain installation of the handle of FIG. 10A to the sheet cassette.

As illustrated in FIG. 10B, the insertion part 45*a* may be inserted into the upward concavity of the pull part 36 from beneath the cover 31*b* and the downward concavity may be fitted around the boss 33*b*. The downward concavity may serve as a positioning part to determine the position of the handle 40*b* relative to the sheet cassette 30*b*. The handle 40*b* may be fastened to the sheet cassette 30*b* with the screw 50 inserted into the boss 33*b*. In other respects, each part of the sheet cassette 30*b* and the handle 40*b* may have a similar configuration to the corresponding part of the sheet cassette 30 and the handle 40 illustrated in FIGS. 3 to 6.

An existing sheet cassette may be modified to the sheet cassette 30*b* by partly modifying a mold for the cover 31*b* and the handle 40*b* may be attached after shipment at a customer site.

Further, the screw 50 may not appear outside of the sheet cassette 30*b* and/or the handle 40*b*, which may prevent an operator from being hooked by the screw 50 and enhance the appearance of the handle 40*b*. The handle 40*b* may be securely attached to the sheet cassette 30*b* with the screw 50 after the position of the insertion part 45*a* is determined by the downward concavity of the insertion part 45*a* and the boss 33*b*.

Figure 11:
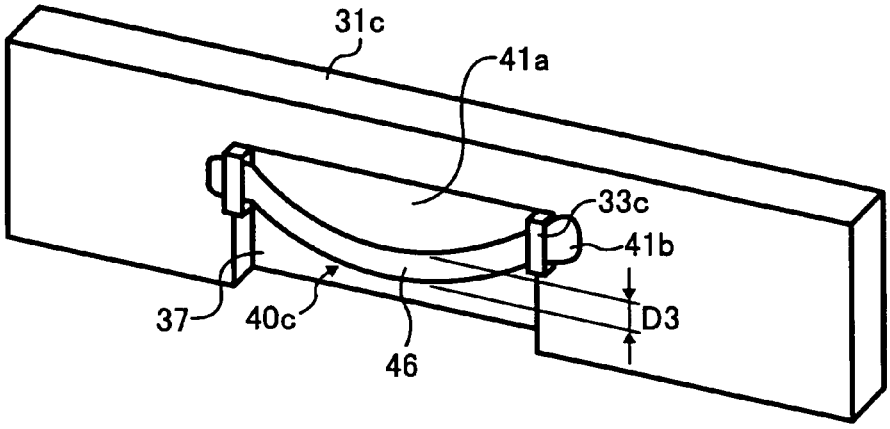
FIG. 11 is an illustration of a handle attached to a sheet cassette according to an example embodiment.
Figure 12:
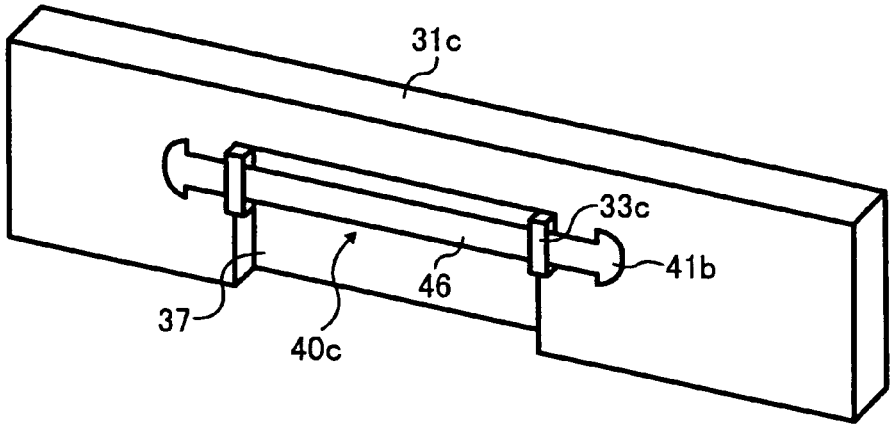
FIG. 12 is an example illustration of the handle of FIG. 12 stowed to the sheet cassette.

Another example embodiment is described with reference to FIGS. 11 and 12. As illustrated in FIGS. 11 and 12, a belt-shaped handle 40*c* may be attached to a cover 31*c* of a sheet cassette 30 (not shown). The cover 31*c* may include a pull part 37 and a pair of slots 33*c*. The handle 40*c* may include a handle part 46. Insertion parts 41*b* (engagement parts) may be provided at both end of the handle part 46. The handle part 46 may form a through-hole 41*a* with the pull part 37. Each of the slots 33*c* may be provided near either end of the pull part 37 in a horizontal direction on the cover 31*c*. The insertion parts 41*b* may be semicircular with diameters larger than a width D3 of the handle part 46. The insertion parts 41*b* may be engaged with the slots 33*c* when inserted into the slots 33*c*.

As illustrated in FIG. 11, the handle part 46 may be curved and serve as a grip for an operator to pull out the sheet cassette 30 when the operator pulls the handle 40*c* attached to the sheet cassette 30. The insertion parts 41*b* may not be easily disengaged when the handle 40*c* is pulled because the diameter of the insertion parts 41*b* may be larger than a width D3 of the handle part 46. The handle 40*c* may be held close to the pull part 37 when not used as illustrated in FIG. 12. In such a case, the handle 40*c* may not protrude from the surface of the cover 31*c*. The handle 40*c* may be selectably attached to the sheet cassette 30 by using insertion part 41*b* and the slots 33*c*.

Therefore, the image forming apparatus 1 including a sheet cassette having an easy-to-use handle for various types of customers may be provided.

In the above example embodiments, the handles to be attached to the sheet cassettes (containers) are explained. Alternatively, the handles may be adapted to any a container to be pulled out. Further, the handles may be adapted to any part which an operator may pull to detach the part from a structure holding the part.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JP2005-376824 filed on Dec. 28, 2005 and No. JP2006-333343 filed on Dec. 11, 2006 in the Japan Patent Office, the entire contents of each of which are incorporated by reference herein.

What is claimed is:

1. An image forming apparatus, comprising:

an image forming mechanism to form an image and to transfer the image onto a recording sheet; and a container configured to contain the recording sheet, including:

a container part;

a handle attachment part; and a handle attachable to and detachable from the handle attachment part of the container and to pull out the container from the image forming apparatus, the handle including an insertion part to attach the handle to the container, and a handle part protruding from a front surface of the container, the handle part including a plate in which a through-hole is provided, a grip to be held through the through-hole, and a front plate configured to cover an edge of the plate, the front plate including the grip.

2. The image forming apparatus according to claim 1, wherein the container further comprises:

a pull part configured to pull out the container from the image forming apparatus when the handle is not attached to the container and to serve as the handle attachment part.

3. The image forming apparatus of claim 1, wherein the insertion part of the handle comprises:

a positioning part catchable on the container and to determine a position of the handle relative to the container.

4. The image forming apparatus of claim 3, wherein the container further comprises:

a cover to cover the container part, wherein the positioning part is caught on steps formed by the cover and a front wall of the container part.

5. The image forming apparatus according to claim 1, wherein the handle further comprises:

a boss provided on the insertion part and configured to protrude from the insertion part toward the handle attachment part of the container.

6. The image forming apparatus according to claim 5, wherein the container further comprises:

a cover to cover the container part, wherein a front wall of the container part is configured so that the boss of the insertion part is visible from above.

7. The image forming apparatus according to claim 1, wherein the container further comprises:

a cover to cover the container part, wherein the insertion part is attachable to the container from beneath the cover.

8. The image forming apparatus of claim 1, wherein the handle attachment part comprises:

a boss part.

9. The image forming apparatus according to claim 1, wherein the front plate includes:

a center part in which the grip is provided; and a first end and a second end, each configured to be in contact with the front surface of the container, wherein the front plate is curved from the first and the second ends toward the center part.

10. The image forming apparatus according to claim 9, wherein the grip has a thickness smaller than a thickness of the front plate.

11. The image forming apparatus according to claim 1, wherein at least one of the handle part and the insertion part includes a lattice-shaped part.

12. The image forming apparatus according to claim 1, wherein the insertion part is attachable to the container from above.

13. A container, including:

a container part;

a handle attachment part; and a handle attachable to and detachable from the handle attachment part of the container and to pull out the container from a structure in which the container is included, the handle including an insertion part to attach the handle to the container, and a handle part protruding from a front surface of the container, the handle part including a plate in which a through-hole is provided, a grip to be held through the through-hole, and a front plate configured to cover an edge of the plate, the front plate including the grip.

14. A handle attachable to and detachable from a part to pull out the part from a structure in which the part is included, the handle including:

an insertion part to attach the handle to the part; and a handle part protruding from a front surface of the part, the handle part including a plate in which a through-hole is provided, and a front plate configured to cover an edge of the plate, wherein the front plate includes a grip to be held through the through hole.

15. The handle of claim 14, wherein the insertion part of the handle comprises:

a positioning part catchable on the part and to determine a position of the handle relative to the part.

16. The handle according to claim 14, wherein the handle further comprises:

a boss provided on the insertion part and configured to protrude from the insertion part toward a handle attachment part of a container.

17. The handle of claim 14, wherein the handle attachment part comprises:

a boss part.

18. The handle according to claim 14, wherein the front plate includes:

a center part in which the grip is provided; and a first end and a second end, each configured to be in contact with the front surface of the part, wherein the front plate is curved from the first and the second ends toward a center part of the front plate.

* * * * *